US006428424B2

(12) United States Patent
Franco

(10) Patent No.: US 6,428,424 B2
(45) Date of Patent: Aug. 6, 2002

(54) GOLF PUTTER

(76) Inventor: Kenneth L. Franco, 16603 Olde Country Rd., Apt. #3, Omaha, NE (US) 68118

( * ) Notice: Subject to any disclaimer, the term of this patent is extended or adjusted under 35 U.S.C. 154(b) by 0 days.

(21) Appl. No.: 09/904,642

(22) Filed: Jul. 13, 2001

Related U.S. Application Data

(60) Provisional application No. 60/218,452, filed on Jul. 14, 2000.

(51) Int. Cl.[7] ..... A63B 53/04; A63B 53/02

(52) U.S. Cl. ..... 473/313; 473/340; 473/342

(58) Field of Search ..... 473/324, 340, 473/341, 342, 251, 313, 330, 325, 334, 336, 337, 349, 282, 291, 223, 231, 242; D21/736–746

(56) References Cited

U.S. PATENT DOCUMENTS

| | | | | |
|---|---|---|---|---|
| 2,542,081 | A | * | 2/1951 | Hockey |
| D217,487 | S | * | 5/1970 | Blake |
| 3,625,517 | A | | 12/1971 | Durnack |
| D233,616 | S | * | 11/1974 | Verzillo |
| 4,111,426 | A | * | 9/1978 | Goodwin |
| 4,138,117 | A | | 2/1979 | Dalton |
| 4,253,667 | A | | 3/1981 | Clark et al. |
| 4,324,404 | A | * | 4/1982 | Dian |
| 4,411,430 | A | | 10/1983 | Dian |
| 4,605,228 | A | | 8/1986 | Guendling, Jr. |
| D293,126 | S | | 12/1987 | Bizovi |
| 4,725,062 | A | * | 2/1988 | Kinney |
| 4,746,124 | A | * | 5/1988 | Comitz |
| 4,872,683 | A | | 10/1989 | Doran et al. |
| D307,309 | S | | 4/1990 | Doran et al. |
| D319,856 | S | | 9/1991 | Wennemar |
| 5,340,106 | A | * | 8/1994 | Ravaris |
| 5,354,055 | A | * | 10/1994 | Mackeil |
| 5,366,223 | A | * | 11/1994 | Werner |
| D356,614 | S | | 3/1995 | Nestorowich |
| 5,417,426 | A | | 5/1995 | Bayer |
| D360,671 | S | * | 7/1995 | Landreth |
| 5,494,282 | A | | 2/1996 | Pranio |
| D380,513 | S | * | 7/1997 | Noda |
| 5,746,665 | A | * | 5/1998 | Wenker |
| 5,769,736 | A | | 6/1998 | Sato |
| 5,795,239 | A | | 8/1998 | Lin |
| 5,795,246 | A | * | 8/1998 | Hale |
| D404,099 | S | | 1/1999 | Mounfield, Jr. |
| D406,293 | S | | 3/1999 | Mounfield, Jr. |
| D410,980 | S | | 6/1999 | Williams et al. |
| 6,017,280 | A | | 1/2000 | Hubert |

* cited by examiner

*Primary Examiner*—Sebastiano Passaniti
(74) *Attorney, Agent, or Firm*—Gifford, Krass, Groh, Sprinkle, Anderson & Citkowski, P.C.

(57) ABSTRACT

A golf putter head includes a body having a side portion, the side portion having an aperture therein adapted to receive a shaft, a basal surface continuous with the side portion, and a semi-circular golf ball contacting face with a bore therein, the face having an appended portion distal to the aperture so as to define a major rotation axis and a minor rotation axis, the major and minor axes defining an angle therebetween β of between 90° and 100° wherein the major axis defines an angle α of between 10° and 25° relative to the normal vector extending from the basal surface through the center of rotation. An insert is adapted to be received within the contacting face bore in order to modify the head putting performance characteristics.

10 Claims, 2 Drawing Sheets

GOLF PUTTER

RELATED APPLICATION

This application claims priority of United States Provisional Patent Application 60/218,452 filed Jul. 14, 2000 and is incorporated herein by reference.

FIELD OF THE INVENTION

The present invention relates to a golf putter and, more particularly, to a putter optimized for putting based upon intended putt length and accuracy.

BACKGROUND OF THE INVENTION

Golf is a popular pastime projected to grow in popularity to over 50 million players by the year 2010. While there are many aspects to the game of golf, success or failure is determined on the putting green. Technical advances in golf have resulted in drivers and wedges producing longer and more accurate shots. The desire to increase the "sweet spot" or optimal club contact surface with the ball has resulted in differentiation of clubs to obtain specific shot distance and trajectory. While the types of drivers and wedges in a club set has increased steadily, golfers still rely on a single trusty putter for shots within the putting green. In spite of the numerous advances in putter weighting, center of gravity, and modified grips, putt shots still account for about half of a golfer's score. Thus, there exists a need to extend the technological developments associated with drivers and wedges to putters in order to obtain a set of at least two putters, each tailored for a different range of putt distances and accuracy.

SUMMARY OF THE INVENTION

A golf putter head includes a body having a side portion, the side portion having an aperture therein adapted to receive a shaft, a surface continuous with the side portion, and a semi-circular golf ball contacting face with a bore therein, the face having an appended portion distal to the aperture so as to define a major rotation axis and a minor rotation axis, the major and minor axes defining an angle therebetween β of between 90° and 100° wherein the major axis defines an angle α of between 10° and 25° relative to the normal vector extending from the basal surface through the center of rotation. An insert is adapted to be received within the contacting face bore in order to modify the head putting performance characteristics.

DETAILED DESCRIPTION OF THE INVENTION

Figure 1:
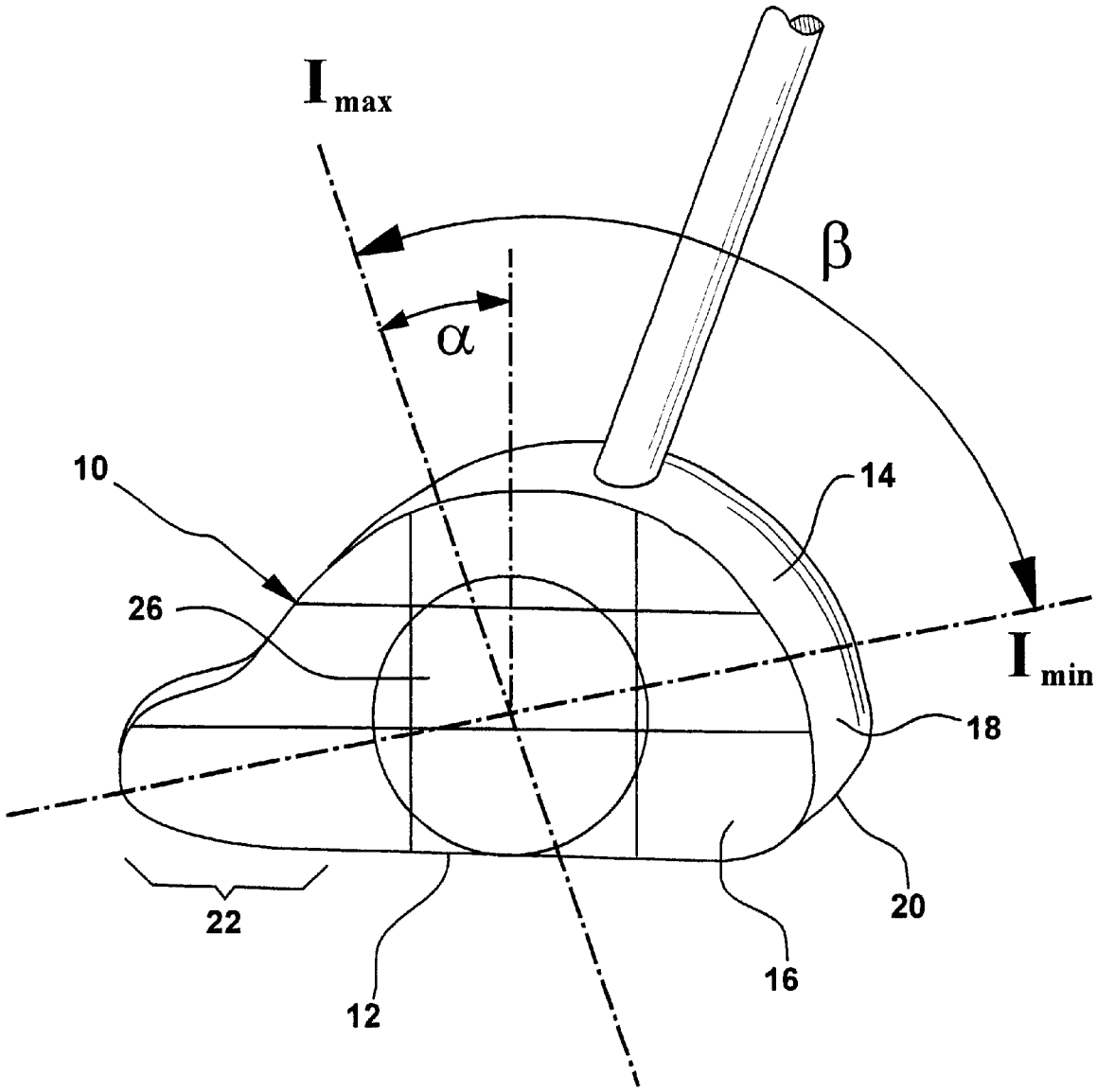
FIG. 1 is a perspective view of a putter head according to the present invention.
Figure 2:
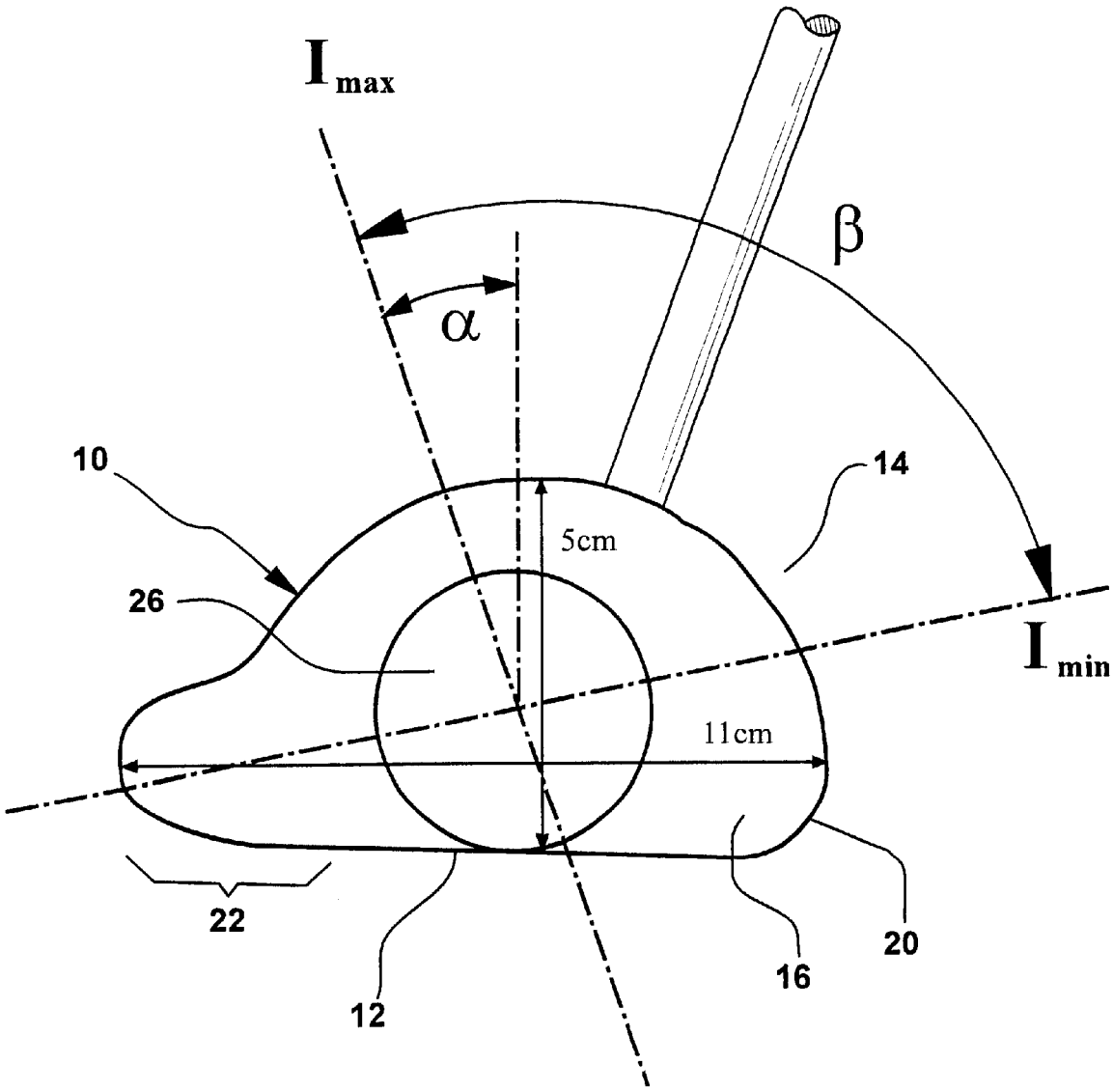
FIG. 2 is a side view of the putter head of FIG. 1.

Referring to the Figures, a golf putter head is shown generally at 10. Golf putter head 10 has a basal surface 12 adapted to be proximal to the turf during the action of putting. The basal surface 12 is continuous with the putter side 14. Putter head 10 has a ball contacting face 16 and a rearward face 18. The ball contacting face 16 is characterized by having a generally semi-circular shaped portion with a lesser appendage portion 22 and side 14 adapted to receive a club shaft. In a preferred embodiment, the basal surface 12 has an upward taper 19 proximal to portion 22 and a taper

20 distal thereto. The ball contacting face preferably having an insert 26 adapted to engage a golf ball.

The relative proportions of the distal appended portion relative to the semi-circular portion of the ball contacting face 16 are selected to define a major rotation axis $I_{MAX}$ and a minor rotation axis $I_{MIN}$ wherein the minor rotation axis $I_{MIN}$ is displaced from the normal vector to the basal surface 12 of the putter head 10 by an angle α. Preferably, $I_{MAX}$ defines an angle β relative to $I_{MIN}$ of between 80° and 110°. More preferably, β is between 90° and 100°. Preferably, angle α is between 5° and 30°. More preferably, angle α is between 10° and 25°. The length of the face 16 along $I_{MIN}$ is typically between 10 and 12 centimeters. Preferably, the length along $I_{MIN}$ is 11 centimeters. The height of the face 16 along $I_{MAX}$ is typically between 4 and 6 centimeters. Preferably, the height along $I_{MAX}$ is 5 centimeters.

In a preferred embodiment, the ball contacting face 16 and the rearward face 18 are approximately parallel. The width of the side 14 is typically between 2 and 3 centimeters. Preferably, the width of the side 14 is essentially uniform, which as used herein defines a thickness that varies by less than 0.2 inches. The width of the putter head side 14 and the materials used are significant factors in defining the putter head mass and therefore the momentum the putter is able to impart with a stroke. The putter head 10 is formed of a solid mass of material with an insert 26 made of materials with different densities. The face 16 has a bore therein adapted to receive the insert 26 and thereby modify the performance characteristics of the head. A putter head according to the present invention formed of materials illustratively is composed of steel, titanium, aluminum, copper, brass, tungsten, graphite, alloys thereof and composites thereof. The putter head being formed by conventional forging or casting methods. Additional materials operative in the formation of a putter head according to the present invention illustratively include carbon fiber, epoxy resins, acrylic resins, fiberglass, wood, ceramic and stone. Preferably, a putter head is formed of aluminum, aluminum alloys, titanium and titanium alloys.

According to the present invention, the optimal ball contacting portion of the face 16 is expanded relative to a conventional putter. Further, a given putter head 10 according to the present invention is tailored to make the resulting putter optimal for a particular range of putt shots and accuracy. Relevant factors in tailoring a putter head according to the present invention for a given shot range include weight, center of gravity, ball contacting face compressibility, angles α and β, and putter insert materials. The combination of factors will favor short or long putts. A preferred insert material particularly well suited for short putts is a graphite-pyrolytic carbon composite.

The foregoing description is illustrative of particular embodiments of the invention, but is not meant to be a limitation upon the practice thereof. The following claims, including all equivalents thereof, are intended to define the scope of the invention.

What is claimed is:

1. A head for a golf putter comprising:

a body having a side portion, the side portion having an aperture therein adapted to receive a shaft, a basal surface continuous with the side portion, and a semi-circular golf ball contacting face with a bore therein, the face having an appended portion distal to the aperture so as to define a major rotation axis and a minor rotation axis, the major and minor axes defining an angle therebetween β of between 90° and 100° wherein the major axis defines an angle α of between 10° and 25° relative to the normal vector extending from the basal surface through the center of rotation; and an insert adapted to be, received within the bore of said face.

2. The head of claim 1 wherein the side is essentially of a uniform width.

3. The head of claim 1 wherein the semi-circular face has a height along $I_{MAX}$ of between 4 and 6 centimeters and a length along $I_{MIN}$ of between 10 and 12 centimeters.

4. The head of claim 1 wherein the aperture is angled to intersect the center of rotation.

5. The head of claim 1 wherein said body is formed of a unitary piece of body material.

6. The head of claim 1 wherein said insert is formed of a material that differs in composition from that of the unitary piece of body material.

7. The head of claim 1 wherein the unitary piece of body material is selected from a group consisting of: steel, titanium, aluminum, copper, brass, tungsten, graphite, alloys thereof and composites thereof, carbon fiber, epoxy resins, acrylic resins, fiberglass, wood, ceramic and stone.

8. The head of claim 6 wherein said insert is formed of the material comprising graphite-pyrolytic carbon.

9. The head of claim 1 wherein the basal surface has an upward taper proximal to the appended portion continuous with the side portion.

10. The head of claim 1 wherein the basal surface has an upward taper distal to the appended portion continuous with the side portion.

* * * * *